US009928986B2

(12) United States Patent
Riedl

(10) Patent No.: US 9,928,986 B2
(45) Date of Patent: Mar. 27, 2018

(54) EMITTER ARRANGEMENT

(71) Applicant: SIEMENS HEALTHCARE GMBH, Erlangen (DE)

(72) Inventor: Christian Riedl, Erlangen (DE)

(73) Assignee: Siemens Healthcare GmbH, Erlangen (DE)

( * ) Notice: Subject to any disclaimer, the term of this patent is extended or adjusted under 35 U.S.C. 154(b) by 0 days.

(21) Appl. No.: 15/240,054

(22) Filed: Aug. 18, 2016

(65) Prior Publication Data

US 2017/0053770 A1 Feb. 23, 2017

(30) Foreign Application Priority Data

Aug. 18, 2015 (DE) ..... 10 2015 215 690

(51) Int. Cl.
*H01J 35/06* (2006.01)

(52) U.S. Cl.
CPC ..... *H01J 35/06* (2013.01)

(58) Field of Classification Search
CPC ..... H01J 35/06; H01J 1/16; H01J 1/22
USPC ..... 313/310
See application file for complete search history.

(56) References Cited

U.S. PATENT DOCUMENTS 3,440,475 A 4/1969 Schiller et al.
6,456,691 B2 * 9/2002 Takahashi ..... B82Y 10/00 378/122
8,000,449 B2 8/2011 Hauttmann et al.
8,227,970 B2 7/2012 Freudenberger
8,477,908 B2 7/2013 Zou et al.
2009/0103683 A1 * 4/2009 Hauttmann ..... H01J 35/06 378/119
2010/0181942 A1 * 7/2010 Freudenberger ..... H01J 1/22 315/326
2010/0316192 A1 * 12/2010 Hauttmann ..... H01J 35/06 378/136
2011/0051898 A1 * 3/2011 Moore ..... H01J 35/06 378/121

FOREIGN PATENT DOCUMENTS

DE 2727907 C2 11/1987
DE 19914739 C1 8/2000
DE 19955845 A1 5/2001
DE 10211947 A1 * 10/2003 ..... H01J 1/135
DE 102009005454 B4 2/2011
DE 102010060484 A1 5/2011
(Continued)

OTHER PUBLICATIONS

Hoerster, H., et al., Philips. Unsere Forschung in Deutschland, vol. 2 (1972), pp. 76-80; 1972.

*Primary Examiner* — Christopher Raabe
(74) *Attorney, Agent, or Firm* — Laurence Greenberg; Werner Stemer; Ralph Locher

(57) ABSTRACT

An emitter arrangement contains at least one emitter and at least one vaporizer element spaced apart therefrom. At least one of the emitters contains at least one emission surface made of at least one first electron emission material and lies at a first potential. At least one of the vaporizer elements contains one evaporation surface made of at least one second electron emission material and lies at a second potential. Thus, the emitter arrangement has a compact configuration and a longer lifetime with simultaneously good emission properties.

16 Claims, 1 Drawing Sheet

(56) References Cited

FOREIGN PATENT DOCUMENTS

| | | | |
|---|---|---|---|
| DE | 102014226048 | A1 | 9/2015 |
| DE | 102014211688 | A1 | 12/2015 |
| EP | 0235619 | A1 | 9/1987 |

* cited by examiner

EMITTER ARRANGEMENT

CROSS-REFERENCE TO RELATED APPLICATION

This application claims the priority, under 35 U.S.C. § 119, of German application DE 10 2015 215 690.7, filed Aug. 18, 2015; the prior application is herewith incorporated by reference in its entirety.

BACKGROUND OF THE INVENTION

Field of the Invention

The invention relates to an emitter arrangement.

An emitter arrangement of this kind contains at least one thermal electron emitter, which is arranged in a cathode, lies at high voltage and is used to generate thermal electrons (so-called "emission current"). The electrons generated by the emitter are then accelerated in an electric field toward an anode and generate X-rays in the anode material.

The lifetime of a thermal electron emitter in an X-ray tube (surface emitter, filament emitter) is primarily determined by the thermally induced evaporation of the emitter material used, as a rule tungsten. Hence, higher lifetimes can be achieved by either a higher emitter material thickness and/or by a reduced maximum emitter temperature. Here, increasing the material thickness of the emitter achieves a linear increase in the lifetime, while the influence of temperature on the material evaporation is subject to exponential dependence.

Due to its exponential temperature dependence, evaporation results in selective reduction in the layer thickness of the emitter at the hottest point at the start of the lifetime and finally results in emitter burnout. The publication titled "The Lifetime of Incandescent Lamps: The Burnout Mechanism of a Tungsten Wire in Vacuum" [Zur Lebensdauer von Glühlampen: Der Durchbrennmechanismus eines Wolframdrahtes im Vakuum] (in German), by H. Hörster et al. in "Our Research in Germany" [Unsere Forschung in Deutschland], Vol II (1972), pages 76 to 80, Philips GmbH (publisher) describes this process in detail using the so-called "spot model". The reduction in the layer thickness of the emitter material at the hottest point of the emitter intensifies exponentially during its lifetime. The distribution of the emission from the emitter changes in that the electron emission is concentrated in the direction of the hottest point. Overall, although a constant emission current requires a heating current that is reduced over time, the maximum temperature of the emitter with respect to a constant emission current increases and, to be precise, until the emitter burns out. Depending upon the form of the grain boundaries in the emitter material, at the hottest point, the emitter can be burnt out to way below 50% of the original thickness, although the average loss of thickness, with respect to the entire emitter is only approximately 15%.

A method is also known with which a modified mechanical incorporation of the emitter in the cathode achieves a reduction of the thermomechanical stresses that occur in the emitter during operation.

A reduction in the emitter temperature requires an enlargement of the emission surface and hence an enlargement of the emitter. Hence, focusing of the emitted electrons to form an electron beam generally entails greater expenditure.

Increasing the material thickness in the region of the emission surface (thicker surface emitter sheet, larger filament wire diameter) requires higher heating currents and results in higher thermal inertia. In the case of surface emitters with connecting legs (surface emitters that are not directly welded), it is only possible to bend the connections as far as a certain emitter thickness. This places limits on increases to material thicknesses.

German patent DE 27 27 907 C2 describes a surface emitter with a rectangular emitter surface. The emitter surface has a layer thickness of approximately 0.05 mm to approximately 0.25 mm and is made, for example of tungsten, tantalum or rhenium. Potassium doping with tungsten is also known. The surface emitter produced by rolling has incisions produced by wire erosion or laser cutting methods and arranged in alternation from two opposite sides and transversal to the longitudinal direction. During the operation of the X-ray tube, heating voltage is applied to the cathode's surface emitter, wherein heating currents of approximately 5 A to approximately 20 A flow and electrons are emitted and accelerated in the direction of an anode. When the electrons arrive at the anode, X-rays are generated in the surface of the anode.

In the surface emitter according to German patent DE 27 27 907 C2, the shape, length and arrangement of the lateral incisions enable special types of temperature distribution to be achieved since the heating of a part heated by the passage of current depends on the distribution of the electric resistance over the current paths. Hence, less heat is generated at points at which the electrically active sheet cross section of the surface emitter than at points with a smaller cross section (points with a higher electrical resistance).

The surface emitter disclosed in German patent DE 199 14 739 C1 is made of rolled tungsten sheet and has a circular emitter surface. The emitter surface is divided into conductive tracks extending in a spiral direction spaced apart from one another by serpentine-shaped incisions.

Furthermore, German patent application DE 10 2014 211 688.0 discloses a monolithic surface emitter. Selectively increasing the thickness of the emitter surface at temperature-critical points causes a local temperature reduction at these points ("three-dimensional" emitter concept).

German patent DE 10 2009 005 454 B4, corresponding to U.S. Pat. No. 8,227,970, discloses an indirectly heated surface emitter. The surface emitter contains a primary emitter and a heating emitter spaced apart therefrom both having a circular primary surface. The primary emitter contains an unstructured primary emission surface, i.e. a homogeneous emission surface without slots. The directly heated heating emitter contains a structured heat emission surface, i.e. an emission surface with slots or serpentine-shaped tracks. The primary emission surface and the heat emission surface are substantially aligned parallel to one another and insulated from one another. Further indirectly heated surface emitters are known from published, non-prosecuted German patent application DE 10 2010 060 484 A1 (corresponding to U.S. Pat. No. 8,477,908) and U.S. Pat. No. 8,000,449 B2.

A cathode with a filament emitter (coiled filament) is for example described in non-prosecuted German patent application DE 199 55 845 A1.

Known from published, European patent application EP 0 235 619 A1 is a surface emitter designated a "band emitter" made up of at least two different layers. The surface emitter is, for example, made up of one layer made of tungsten and at least one further layer (for example the two outer layers) made of tantalum. The layers of the surface emitter can consist of different structures of the same material (for example normally structured tungsten and polycrystalline tungsten). This ensures that the grain boundaries at the transition between the two layers are not continued so that the risk of fracture for the surface emitter along such grain boundaries that have developed over the entire material thickness is significantly reduced. However, this does not achieve any reduction in the evaporation of emitter material.

A further alternative, which is based on the field emission of electrons and is therefore known as "field emitter", is, for example, described in the German patent application DE 10 2014 226 048.5. To date, such field emitters are not used in high-power X-ray tubes.

SUMMARY OF THE INVENTION

It is the object of the present invention to provide a compact emitter arrangement with a longer lifetime which simultaneously has good emission properties.

The emitter configuration contains at least one emitter and at least one vaporizer element spaced apart therefrom, wherein at least one of the emitters contains at least one emission surface made of at least one first electron emission material and lies at a first potential and at least one of the vaporizer elements contains at least one evaporation surface made of at least one second electron emission material and lies at a second potential.

With the emitter arrangement according to the invention, the vaporizer element is spaced apart from the emitter. The emission surface(s) of the emitter and the evaporation surface(s) of the vaporizer element are in each case made of at least one electron emission material and lie at a prespecified potential. The electron emission material that is reduced during the thermal emission of the electrons due to the thermal evaporation of the electron emission material is replaced in a simple and effective way by the electron emission material of the vaporizer element. The replacement of the electron emission material preferably takes place during stoppages in which the emitter does not emit any electrons. Hence, this is a simple way of preventing electrons emitted by the vaporizer element from reaching the anode and hence from being able to exert a negative influence on the image quality.

The emitter in the emitter configuration has a longer lifetime, since the electron emission material evaporated from the emission surface during operation is replaced by the vaporizer element. To this end, it is not necessarily preferable for deposition to take place at individual points of the emitter; instead it is generally sufficient for deposition to take over a large area and continuously during operational stoppages in order to avoid spot formation according to the described spot model.

As long as the first electron emission material evaporated from the emitter is replaced by the second electron emission material of the vaporizer element, uniform emission distribution is guaranteed. This obtains a constant focal spot quality and, as a result, a constant image quality over a significantly extended lifetime of the emitter. Hence, problems with the lifetime of the anode due to focal spots that are possibly becoming too small, which can occur due to the emission surfaces that are reducing in size, are also reliably avoided.

Alternatively or additionally to a higher emitter lifetime of the emitter, the solution according to the invention can also achieve a higher emitter temperature. This can, for example, be used for higher emission currents with lower anode voltages or for the use of smaller emitters. Smaller emitters generally offer advantages with respect to emitter lockability and focusability or the achievable image quality.

Within the scope of the invention, the first electron emission material (emitter electron emission material) and/or the second electron emission material (vaporizer element electron emission material) can be identical or different.

For example, according to a preferred embodiment the first electron emission material is made of tungsten (W), tantalum (Ta) or rhenium (Re).

According to a further embodiment, the second electron emission material is tungsten (W), tantalum (Ta) or rhenium (Re).

In an exemplary embodiment, the first electron emission material is made of lanthanum oxide (La2O3), hafnium carbide (HfC), tantalum carbide (TaC) or tantalum hafnium carbide (TaxHf1-xCy).

In a further embodiment, lanthanum oxide (La2O3), hafnium carbide (HfC), tantalum carbide (TaC) or tantalum hafnium carbide (TaxHf1-xCy) are provided as the second electron emission material.

Within the scope of the invention, both the emission surface of the emitter and the evaporation surface of the vaporizer element can be made of a sequence of layers of different electron emission materials. For example, the emission surface of the emitter can be made of tungsten (W) and additionally coated with lanthanum oxide ($La_2O_3$) in order to reduce the work function of the thermally emitted electrons. With this embodiment, it is for example possible, if necessary, with a first vaporizer element, to coat the rear side of the emission surface with tungsten and, with a second vaporizer element, to coat the front side of the emission surface with lanthanum oxide.

There are several possibilities for the spacing of the vaporizer element within the scope of the invention. For example the vaporizer element can be arranged at a distance from the rear side of the emitter. In a further alternative, the vaporizer element can be moved into a prespecifiable distance from the emitter by an adjusting unit. An adjusting unit of this kind can, for example, be used to bring the vaporizer element into the necessary position by a swinging motion or sliding motion.

According to different advantageous embodiments, the emission surface of the emitter and/or the evaporation surface of the vaporizer element are embodied as rectangular, circular or helical.

If the emitter contains at least one helical emission surface, then, the vaporizer element can contains at least one glow wire. A vaporizer element structure of this kind is suitable for the application of the consumed electron emission material to the rear side of the emission surface in a particularly simple way. Alternatively, the vaporizer element can also contain a helical evaporation surface with a smaller diameter than that of the emitter.

There are two possible alternatives for the first potential (the emitter potential) and for the second potential (vaporizer element potential). According to an embodiment, the first potential and the second potential have the same value. According to a further embodiment, the second potential is more positive than the first potential. With an embodiment, for example, a small differential voltage, for example of less than 100 V, between the vaporizer element and the emitter is advantageous in order selectively to divert the second electron emission material which is present in the form of ions in the direction of the emission surface.

Other features which are considered as characteristic for the invention are set forth in the appended claims.

Although the invention is illustrated and described herein as embodied in an emitter arrangement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
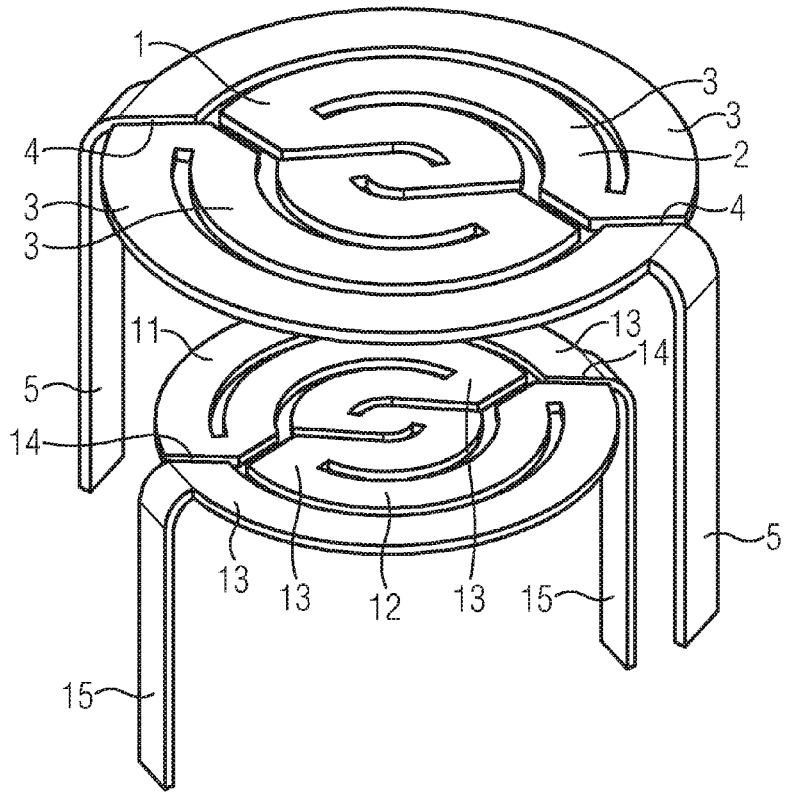
FIG. 1 is a diagrammatic, perspective depiction of a first embodiment of an emitter arrangement according to the invention.

Referring now to the figures of the drawings in detail and first, particularly to FIG. 1 thereof, there is shown an emitter 1 embodied as a surface emitter and having a circular emission surface 2. The circular emission surface 2 is divided into conductor tracks 3 extending in a spiral shape spaced apart from one another by serpentine incisions 4. Two legs 5 are molded onto the emitter 1 via which the emitter 1 lies at a first potential, wherein once again there is a corresponding heating current flow.

A vaporizer element 11 is arranged spaced apart from the emitter 1. The vaporizer element 11 contains a circular evaporation surface 12. The circular evaporation surface 12 is divided into conductor tracks 13 extending in a spiral shape, which are spaced apart from one another by serpentine incisions 14. Two legs 15 are molded onto the vaporizer element 11 via which the vaporizer element 11 lies at a second potential, wherein once again there is a corresponding heating current flow.

Figure 2:
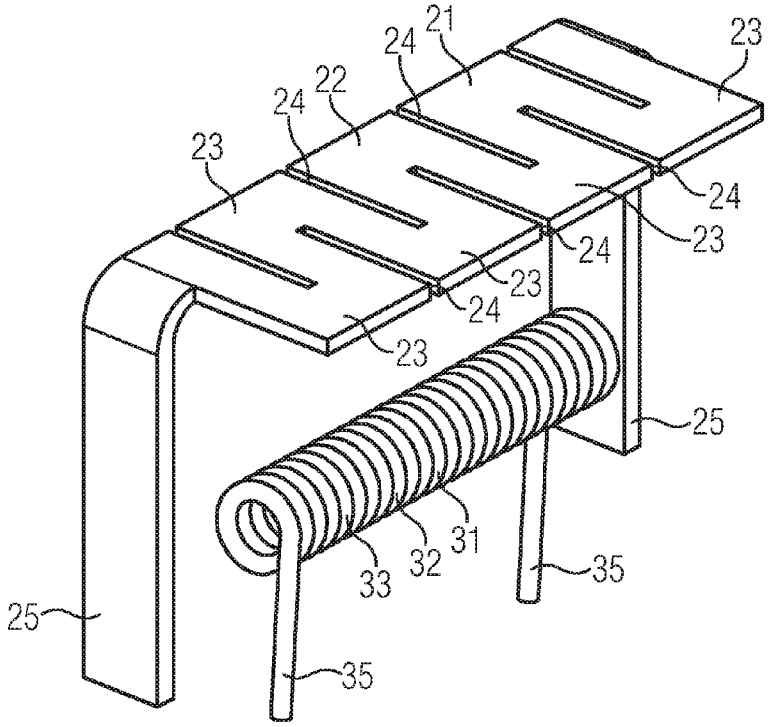
FIG. 2 is a perspective depiction of a second embodiment of the emitter arrangement according to the invention.

FIG. 2 shows an emitter 21 embodied as a surface emitter and containing a rectangular emission surface 22. The rectangular emission surface 22 contains incisions 24 arranged in alternation from two opposite sides and transversal to the longitudinal direction. The incisions 24 again form corresponding conductor tracks 23 in the rectangular emission surface 22. In order to apply a first potential (heating voltage) to the emitter 21 during the operation of the X-ray tube and supply a corresponding heating current, the emitter once again also contains two legs 25.

A vaporizer element 31 is arranged spaced apart from the emitter 21. In the exemplary embodiment shown, the vaporizer element 31 contains a helical evaporation surface 32. The helical evaporation surface 32 is formed by helical conductor tracks 33 which are spaced apart from one another. To enable the evaporation surface 32 to be supplied with a heating voltage, the vaporizer element 31 contains two legs 35 with which the vaporizer element 31 is taken to a second potential, wherein once again there is a corresponding heating current flow.

With the exemplary embodiments shown in FIGS. 1 and 2, the emitter 1 or the emitter 21 are each embodied as a structured, conventional surface emitter which is supplied directly with current via its two legs 5 or 25. The associated vaporizer element 11 or 31 is in each case arranged spaced apart below or behind the surface emitter 1 or 21, wherein the specified distance between the emitter 1 or 21 and the vaporizer element 11 or 31 is from a few 100 μm to a few mm.

Here, the evaporation surface 12 or 32 of the vaporizer element 11 or 31 should not be larger than the emission surface 2 or 22 of the emitter 1 or 21 in order only to apply the electron emission material (for example tungsten) selectively to the hottest points of the emitter 1 or 21 on the rear side. Ideally, the vaporizer element 11 or 31 has the same temperature distribution as the emitter 1 or 21.

The electron emission material is preferably deposited when no X-rays are being generated or at least no high voltage is applied to the anode. During the deposition, the emitter 1 or 21 can be switched off or have a freely selectable temperature (for example a standby temperature).

When tungsten is used as the electron emission material, the formation of tungsten oxide during the deposition process can be suppressed by sufficiently high temperatures. The vaporizer element has temperatures of approximately 2,500° C. to 3,000° C.; the emitter can be heated without a significant loss of lifetime to approximately 2,000° C. to 2,200° C.

With the embodiments shown in FIGS. 1 and 2, the deposited tungsten is exclusively compensated on the rear side of the emission surface 2 of the emitter 1 or the emission surface 22 of the emitter 21. The loss of the electron emission material (tungsten) is higher on the rear side of the emission surface 2 or 22 than on the front side of the emission surface 2 or 23 since, unlike the case with the front side of the emission surface 2 or 22, the heat emitted in the environment of the focusing head or the vaporizer element 11 or 31 is reflected.

The expected increase in lifetime with the emitter arrangement shown in FIGS. 1 and 2 is due to the fact that the amount of electron emission material to be compensated with emitter 1 or 21 (due to deposition exclusively from the underside) can in a first approximation be compensated by a (directly supplied with current) vaporizer element 11 or 31 with double the thickness of the evaporation surface 12 or 32.

Although the invention was illustrated and described in more detail by the preferred exemplary embodiment, the invention is not restricted by the exemplary embodiments shown in the drawing. Instead, the person skilled in the art can also derive other variants of the solution according to the invention without departing from the underlying concept of the invention.

For example, the tungsten vaporizer can also be attached in the focusing head or in the X-ray tube such that the electron emission material is deposited onto the emitter 1 or 21 from the front or from above. Under some circumstances, this requires an adjusting unit which brings the vaporizer element into the necessary position before the deposition of the electron emission material and swings or slides it away again after the deposition of the electron emission material. This embodiment, with which the electron emission material is deposited onto the emitter from above, is suitable for all types of thermal emitters.

It is also possible in individual cases to embody both the actual emitter and the vaporizer element as indirectly heated emitters.

As is evident from the description of the exemplary embodiments shown in the drawing, the solution according to the invention, in the case of an emitter arrangement containing an emitter, also to provide a vaporizer element spaced apart from the emitter achieves a longer lifetime of the emitter with simultaneously good emission properties.

The invention claimed is:

1. An emitter configuration, comprising:

at least one emitter having at least one structured emission surface for emitting electrons and formed of a plurality of mutually adjacent and spaced apart partial emission surfaces, said at least one structured emission surface made of at least one first electron emission material and lies at a first potential; and at least one vaporizer element spaced apart from said at least one emitter, said at least one vaporizer element having at least one evaporation surface made of at least one second electron emission material and lies at a second potential.

2. The emitter configuration according to claim 1, wherein said first electron emission material is selected from the group consisting of tungsten (W), tantalum (Ta) and rhenium (Re).

3. The emitter configuration according to claim 1, wherein said second electron emission material is selected from the group consisting of tungsten (W), tantalum (Ta) and rhenium (Re).

4. The emitter configuration according to claim 1, wherein said first electron emission material is selected from the group consisting of lanthanum oxide ($La_2O_3$), hafnium carbide (HfC), tantalum carbide (TaC) and tantalum hafnium carbide (TaxHf1−xCy).

5. The emitter configuration according to claim 1, wherein said second electron emission material is selected from the group consisting of lanthanum oxide ($La_2O_3$), hafnium carbide (HfC), tantalum carbide (TaC) and tantalum hafnium carbide (TaxHf1−xCy).

6. The emitter configuration according to claim 1, wherein said vaporizer element is disposed at a distance from a rear side of said emitter.

7. The emitter configuration according to claim 1, wherein said vaporizer element can be moved by means of an adjusting unit into a prespecifiable distance from said emitter.

8. The emitter configuration according to claim 1, wherein said emitter has at least one rectangular emission surface.

9. The emitter configuration according to claim 1, wherein said emitter has at least one circular emission surface.

10. The emitter configuration according to claim 1, wherein said emitter has at least one spiral-shaped emission surface.

11. The emitter configuration according to claim 1, wherein said vaporizer element has at least one rectangular evaporation surface.

12. The emitter configuration according to claim 1, wherein said vaporizer element contains at least one circular evaporation surface.

13. The emitter configuration according to claim 1, wherein said vaporizer element contains at least one helical evaporation surface.

14. The emitter configuration according to claim 10, wherein said vaporizer element contains at least one glow wire.

15. The emitter configuration according to claim 1, wherein the first potential and the second potential are the same.

16. The emitter configuration according to claim 1, wherein the second potential is more positive than the first potential.

* * * * *